United States Patent [19]

Dionne

[11] 4,043,845

[45] Aug. 23, 1977

[54] CARBON STABILIZED COBALT-RARE EARTH MAGNETIC MATERIALS

[75] Inventor: Norman J. Dionne, Arlington Heights, Mass.

[73] Assignee: Raytheon Company, Lexington, Mass.

[21] Appl. No.: 636,177

[22] Filed: Nov. 28, 1975

[51] Int. Cl.[2] ..... H01F 1/02; C22C 23/00; B22F 3/00

[52] U.S. Cl. ..... 148/105; 75/152; 75/243; 148/103; 252/62.55; 428/928

[58] Field of Search ..... 148/31.57, 105, 103; 75/152, 201, 203, 84, 230, 243; 29/182.5; 252/62.54, 62.55, 62.53; 428/928

[56] References Cited

U.S. PATENT DOCUMENTS

| | | | |
|---|---|---|---|
| 3,677,947 | 7/1972 | Ray et al. | 252/62.54 |
| 3,867,299 | 2/1975 | Rohatgi | 252/62.54 |
| 3,933,536 | 1/1976 | Doser et al. | 148/105 |

*Primary Examiner*—Walter R. Satterfield
*Attorney, Agent, or Firm*—John T. Meaney; Joseph D. Pannone; Harold A. Murphy

[57] ABSTRACT

A magnetic material comprising a substantially homogeneous mixture of rare earth, cobalt, and carbon elements, the percentage weight of the carbon component being in the range of about 1 percent and one-hundreth of one percent of the mixture; and a magnet made therefrom.

A method for stabilizing the coercivity of sintered rare earth-cobalt magnetic material and comprising the steps of mixing rare earth and cobalt constituent materials with a carbon constituent material having a percentage weight in the range of about 1 percent and one-hundredth of one percent of the mixture, grinding the mixture to a fine powder, and heating the powder particles to a suitable temperature for causing the more mobile carbon component to migrate to the surfaces of the respective powder particles and forming protective carbonaceous overlayers thereon which inhibit oxidation and evaporation of the samarium and cobalt components, thereby freeing more samarium for union with cobalt and permitting sintering thereof to be carried at a substantially lower temperature than conventional samarium-cobalt magnetic material having no carbon component.

6 Claims, No Drawings

CARBON STABILIZED COBALT-RARE EARTH MAGNETIC MATERIALS

BACKGROUND OF THE INVENTION

The invention relates generally to powder magnetic material and is related more particularly to a means for stabilizing the magnetic properties of sintered rare earth-cobalt magnets.

Generally, in powder material fabrication of magnets, such as rare earth-cobalt magnets, for example, the elemental components are mixed in a molten state to produce a desired composition material. The composition material usually is ground to a fine powder which then may be compacted into a desired configuration while exposed to a particle aligning magnetic field. After degaussing, the compacted device may be subjected to suitable sintering temperature for producing shrinkage and greater densification of the compacted powder material. As a result, the aligned powder particles are bonded to one another; and the magnetic properties of the composition material ae greatly enhanced. Accordingly, when the sintered material is magnetized in the direction of particle alignment, a device having high magnetic coercivity and energy product is produced.

After sintering, it may be found that the packing density of the compacted material has increased to as much as 97 percent of a theoretical maximum value, which is determined by dividing the weight per unit volume by the density of the material. It is well-known that greater densification of the powder material would produce a correspondingly higher magnetization and energy product levels. However, if the sintering temperature is increased to achieve a greater packing density of the powder material, excessive grain growth may occur and cause a significant loss in magnetic coercivity. Consequently, it is common practice to select a compromise sintering temperature which will provide adequate densification of the powder material while avoiding excessive grain growth during the sintering operation.

Therefore, it is advantageous and desirable to provide a magnetic powder material having means for increasing packing density and curbing grain growth during the sintering operation.

SUMMARY OF THE INVENTION

Accordingly, this invention provides a rare earth-cobalt magnetic powder material having included therein a carbon component, which is between 1 percent and one-hundredth of one percent by weight of the material.

The rare earth, cobalt, and carbon components may be mixed homogeneously at a suitable temperature to form a molten composite material, which then is quenched to produce a corresponding solid material. The solid composite material may be ground to coarse particle size and mixed with a suitable organic solvent for forming a slurry in order to inhibit oxidation of particles during comminution. The slurry may be further ground to reduce the solid material to a fine powder, which may have an average particle size of about 10 microns, for example. It is preferable to provide a fine powder having an average particle size on the order of a single magnetic domain size in the finished device. The slurry is then heated at a suitable elevated temperature in an evacuated chamber to drive off the solvents and dry out the fine powder material.

Generally, when conventional rare earth-cobalt magnetic powder material is dried and then exposed to air, the rare earth component oxidizes very rapidly, thereby reducing the amount of rare earth component available for union with the cobalt component in the respective powder particles. However, in the practice of this invention, the carbon component of the respective particles migrates to the surfaces thereof during the drying operation, since the carbon component is more mobile at elevated temperatures than the rare earth and cobalt component. As a result, each of the respective particles is provided with a carbonaceous overlayer where the carbon component unites readily with the oxygen at the surface boundaries of the particles. Consequently, oxygen is inhibited from penetrating the bulk material of the respective particles, thereby protecting the rare earth component from excessive oxidation and evaporation. Accordingly, an unexpectedly greater amount of the rare earth component is available for union with the cobalt component, as compared to conventional rare earth-cobalt magnetic powder material having no carbon component.

The dried powder particles, thus produced, may be compacted into a desired shaped device while exposed to a suitable particle aligning magnetic field. Subsequently, the compacted powder device may be heated to a preferred sintering temperature in an evacuable chamber filled with an inert gas, such as helium, for example. During the sintering operation, which is carried out at a considerably higher temperature than the drying temperature, the oxygen trapped interstitially by the carbon components in the protective overlayers of the respective particles evolves as carbon monoxide or carbon dioxide gaseous matter. However, the resulting voids are filled in by shrinkage and increased densification taking place during sintering due to crystal grain growth and bonding of the particles to one another. As a result, greater densification takes place in the magnetic powder material of this invention due to the removal of interstitially trapped oxygen which inhibits crystal grain growth. Also, at the elevated sintering temperature, more of the carbon component in the respective powder particles migrates to the surfaces thereof and replenishes the carbon evolving with the oxygen from the protective overlayers, and lessen evaporation of the rare earth component. Accordingly, it is found that due to the unexpectedly greater amount of rare earth component available for union with the cobalt components in the respective powder particles, the sintering operation may be carried out at a substantially lower temperature than required for sintering conventional rare earth-cobalt material having no carbon component.

After cooling, the sintered device, thus produced, may be magnetized by placing it in a magnetic field having lines of force directed substantially parallel with the aligned powder particles of the device. As a result of the greater amount of rare earth component available for diffusion bonding during the sintering operation and the accompanying greater densification achieved, the magnet device produced in accordance with this invention has magnetic properties superior to the properties of magnet devices made from conventional rare earth-cobalt materials. Also, the carbonaceous overlayer provided at the surface boundaries of the respective powder particles in the magnet device of this invention is available for protecting the bulk materials from oxidation, evaporation, and decomposition during the life of the device, and particularly during high temperature operation thereof.

DESCRIPTION OF THE PREFERRED EMBODIMENT

Initially, in accordance with this invention, constituent materials are mixed substantially homogeneously to produce a composite material or alloy having desired proportions of rare earth, cobalt, and carbon components, the carbon component being between 1 percent and one-hundredth of one percent by weight of the composite material. The preferred percentage weight of the carbon component may be determined by the amount of oxygen expected to be introduced into the composite material during processing, and may be slightly less than the percentage weight of the oxygen thus introduced. Accordingly, if the oxygen is expected to be about one-quarter of one percent by weight, the carbon component preferably may be one-tenth of one percent by weight of the composite material.

The rare earth component may comprise one or more members of the group including the rare earth elements extending from lanthanum through lutetium in the Periodic Table, and rare earth mischmetals. However, for purposes of illustrating this invention, samarium is selected as the rare earth component of the composite material. Thus, the composite material may include a samarium component having a percentage weight in the range of about 33 percent to about 42 percent, a carbon component having a percentage weight in the range of about 1 percent to about one-hundredth of one percent, and a cobalt component having a percentage weight proportional to the remaining weight of the composite material. Accordingly, a preferred composite material may comprise 36 percent by weight samarium, 63 9/10 percent weight cobalt, and one-tenth of one percent by weight carbon. Also, the preferred composite material may have a chemical composition including $SmCo_5$ and $Sm_2Co_7$ in respective proportions of about sixty and forty parts relative to one another.

The samarium, cobalt, and carbon components may be mixed by placing substantially pure elemental materials thereof into a crucible made of nonreactive material, such as alumina, for example, and heating them to a preferred melting temperature, such as 1300° Centigrade, for example. As a result, the samarium material melts; and the cobalt and carbon components dissolve atomically into the liquid samarium. The melting operation may be carried out in an enclosed chamber filled with inert gas such as helium, for example. Preferably, the inert gas is maintained at a pressure of one atmosphere to minimize evaporation of the samarium components. However, despite these precautions, it is believed that a small amount of oxygen is introduced into the molten material from various sources, such as a crucible, for example. After waiting a sufficient interval of time to insure a homogeneous mixture of the constituent materials, the molten composite material may be poured from the crucible onto a cold plate located at the bottom of the chamber to convert the composite homogeneous material to solid form.

The solid material, thus obtained, is pulverized in an inert gas atmosphere, such as argon, for example, to produce a coarse powder which may have an average particle size of about 150 microns, for example. The coarse powder then is mixed with a volatile organic solvent, such as Chlorothene NU, which is a trademark of Dow Chemical Company of Midland, Mich., for example, to produce a slurry for the purpose of minimizing oxidation of the powder particles. The slurry is ground by conventional means, as by ball milling for example, to reduce the coarse particles to a fine powder, which is then heated to a slightly elevated temperature, such as 200° Centigrade, for example. As a result, the organic solvent volatizes; and the fine powder particles are dried. Also, during the drying operation the carbon components of the respective fine particles, being more mobile than the samarium and cobalt components, migrate to the surfaces of the respective particles and form a protective overlayer thereon. Consequently, oxidation takes place in the carbonaceous overlayer at the surface boundaries of the particles thereby protecting the samarium component in the bulk material from excessive oxidation and evaporation.

Subsequently, the fine particles of composite material are compacted into a desired configuration while exposed to a particle aligning magnetic field. Consequently, additional stress is introduced into the powder material during the compressing and aligning operation. After degaussing, the compacted device is heated to a suitable sintering temperature such at 1130° Centrigrade, for example. While heating to a sintering temperature, incomplete annealing of the compacted powder particles takes place whereby some of the crystal defects introduced during the grinding and compacting operations are removed. During sintering, the oxygen united with the carbon in the protective overlayers of the powder particles evolves therefrom as carbon monoxide or carbon dioxide gases. The resulting voids in the material are filled by virtue of the unexpectedly greater amount of samarium available for diffusion bonding of the particles. Consequently, greater densification and skrinkage takes place in the sintered material of this invention than would be expected to take place during sintering of conventional samarium-cobalt powder material. Consequently, it has been found that the sintering temperature or the sintering time interval may be decreased substantially as compared to the equivalent parameter generally used in the sintering of conventional samarium-cobalt material. For example, the magnetic powder material may be sintered at a temperature one hundred degrees lower than the characteristic sintering temperature for samarium-cobalt material.

After sintering, the temperature is reduced to a suitable annealing temperature such as 900° Centigrade, for example, in order to remove the remaining defects from the crystal structure. Generally, the annealed operation is terminated before removing all the crystal defects, in order to avoid excessive grain growth which deteriorates the magnetic properties of the sintered material. However, crystal grain growth is controlled in the material of this invention by the carbon protective monolayers surrounding the prospective particles. Therefore, the annealing operation may be continued until substantially all crystal defects have been removed from the sintered material.

After annealing is complete, the sintered composite material is thermally quenched by rapidly reducing its temperature to a considerably lower temperature, such as room temperature, for example. Subsequently, the sintered device may be magnetized by placing it in a magnetic field having a direction coinciding with the aligned particles of the sintered material. As a result of the higher packing density achieved during the sintering operation, it is found that the resulting product has a higher coercivity and energy produced as compared to similar magnetic devices made of conventional samarium-cobalt powder material. The material of the finished magnet device comprises samarium and cobalt components with minor vestiges of carbon and oxygen. Thus, the carbon component also may serve to protect the material during the lifetime of the magnet device, particularly during high temperature operation.

From the foregoing, it will be apparent that all of the objectives of this invention have been achieved by the magnetic material and method described herein. It also will be apparent, however, that various changes may be made by those skilled in the art without departing from the spirit of the invention, as expressed in the appended claims. It is to be understood, therefore, all matter shown and described herein is to be interpreted in an illustrative rather than in a restrictive sense.

What is claimed is:

1. A magnetic composite material comprised of powder particles, each particle comprising a bulk mixture of rare earth, cobalt, and elemental carbon constituents, and a protective overlayer of elemental carbon.

2. A magnetic composite material as set forth in claim 1 wherein the carbon is no greater than 1 percent by weight of the composite material.

3. A magnetic composite material as set forth in claim 2 wherein the powder particles have an average size less than 50 microns.

4. A magnetic composite material as set forth in claim 1 wherein the rare earth constitutuent includes samarium.

5. A magnetic composite material as set forth in claim 5 wherein the samarium has a percentage weight in the range of about 36 to about 42 percent of the composite material.

6. A magnetic composite material as set forth in claim 6 wherein the samarium comprises 36 percent by weight, the carbon comprises one-tenth of one percent by weight, and the cobalt comprises substantially the remainder of the composite material.

* * * * *